US009994357B2

(12) United States Patent
Thorstensen-Woll

(10) Patent No.: US 9,994,357 B2
(45) **Date of Patent: *Jun. 12, 2018**

(54) INNER SEAL WITH A SUB TAB LAYER

(71) Applicant: Selig Sealing Products, Inc., Forrest, IL (US)

(72) Inventor: Robert William Thorstensen-Woll, Barrie (CA)

(73) Assignee: Selig Sealing Products, Inc., Forrest, IL (US)

( * ) Notice: Subject to any disclaimer, the term of this patent is extended or adjusted under 35 U.S.C. 154(b) by 23 days.

This patent is subject to a terminal disclaimer.

(21) Appl. No.: 15/254,705

(22) Filed: Sep. 1, 2016

(65) Prior Publication Data

US 2016/0368657 A1 Dec. 22, 2016

Related U.S. Application Data

(63) Continuation of application No. 14/208,106, filed on Mar. 13, 2014, now Pat. No. 9,440,765.
(Continued)

(51) Int. Cl.
*B65D 17/50* (2006.01)
*B65D 51/20* (2006.01)
(Continued)

(52) U.S. Cl.
CPC ..... *B65D 17/501* (2013.01); *B65D 17/50* (2013.01); *B65D 43/02* (2013.01); *B65D 51/005* (2013.01); *B65D 51/20* (2013.01); *B65D 2251/0009* (2013.01); *B65D 2251/009* (2013.01); *B65D 2251/0015* (2013.01); *B65D 2251/0018* (2013.01); *B65D 2251/0028* (2013.01); *B65D 2251/0071* (2013.01); *B65D 2251/0093* (2013.01); *B65D 2517/0013* (2013.01);
(Continued)

(58) Field of Classification Search
None
See application file for complete search history.

(56) References Cited

U.S. PATENT DOCUMENTS 2,768,762 A 10/1956 Eugene
3,235,165 A 2/1966 Jackson
(Continued)

FOREIGN PATENT DOCUMENTS

AT 501393 A1 8/2006
AT 11738 U1 4/2011
(Continued)

OTHER PUBLICATIONS

Patent Cooperation Treaty, International Search Report and Written Opinion dated May 19, 2016 for International Application No. PCT/US2016/020666, 9 pages.

*Primary Examiner* — David Sample
*Assistant Examiner* — Donald M Flores, Jr.
(74) *Attorney, Agent, or Firm* — Fitch, Even, Tabin & Flannery, LLP

(57) ABSTRACT

A pull-tab sealing member for a container containing an upper laminate forming a pull-tab bonded to a lower laminate capable of being heat sealed to a container's mouth or opening. The upper laminate defines the pull tab wholly within a perimeter or circumference of the seal. The sealing member further includes a sub tab layer or member under the gripping tab for structural support.

27 Claims, 6 Drawing Sheets

Related U.S. Application Data

(60) Provisional application No. 61/791,788, filed on Mar. 15, 2013.

(51) Int. Cl.
*B65D 51/00* (2006.01)
*B65D 43/02* (2006.01)

(52) U.S. Cl.
CPC ..... *B65D 2517/0082* (2013.01); *B65D 2577/2058* (2013.01); *Y10T 428/12486* (2015.01); *Y10T 428/1486* (2015.01)

(56) References Cited

U.S. PATENT DOCUMENTS 3,292,828 A 12/1966 Stuart
3,302,818 A 2/1967 Balocca et al.
3,460,310 A 8/1969 Adcock et al.
3,556,816 A 1/1971 Nughes
3,964,670 A 6/1976 Amneus
3,990,603 A 11/1976 Brochman
4,133,796 A 1/1979 Bullman
4,206,165 A 6/1980 Dukess
4,582,735 A 4/1986 Smith
4,588,099 A 5/1986 Diez
4,596,338 A 6/1986 Yousif
4,636,273 A 1/1987 Wolfersperger
4,666,052 A 5/1987 Ou-Yang
4,735,335 A 4/1988 Torterotot
4,741,791 A 5/1988 Howard
4,770,325 A 9/1988 Gordon
4,781,294 A 11/1988 Croce
4,801,647 A 1/1989 Wolfe, Jr.
4,811,856 A 3/1989 Fischman
4,818,577 A 4/1989 Ou-Yang
4,837,061 A 6/1989 Smits
4,863,061 A 9/1989 Moore
4,867,881 A 9/1989 Kinzer
4,889,731 A 12/1989 Williams
4,938,390 A 7/1990 Markva
4,960,216 A 10/1990 Giles
4,961,986 A 10/1990 Galda
5,004,111 A 4/1991 McCarthy
5,015,318 A 5/1991 Smits
5,053,457 A 10/1991 Lee
5,055,150 A 10/1991 Rosenfeld
5,057,365 A 10/1991 Finkelstein
5,071,710 A 12/1991 Smits
5,098,495 A 3/1992 Smits
RE33,893 E 4/1992 Elias
5,125,529 A 6/1992 Torterotot
5,131,556 A 7/1992 Iioka
5,149,386 A 9/1992 Smits
5,178,967 A 1/1993 Rosenfeld
5,197,618 A 3/1993 Goth
5,217,790 A 6/1993 Galda
5,226,281 A 7/1993 Han
5,265,745 A 11/1993 Pereyra
5,433,992 A 7/1995 Galda
5,513,781 A 5/1996 Ullrich
5,514,442 A * 5/1996 Galda ..... B65D 51/20 215/232
5,560,989 A 10/1996 Han
5,598,940 A 2/1997 Finkelstein
5,601,200 A 2/1997 Finkelstein
5,615,789 A 4/1997 Finkelstein
5,618,618 A 4/1997 Murschall
5,669,521 A 9/1997 Wiening
5,702,015 A 12/1997 Giles
5,860,544 A 1/1999 Brucker
5,871,112 A 2/1999 Giles
5,915,577 A 6/1999 Levine
5,975,304 A 11/1999 Cain
6,082,566 A 7/2000 Yousif
6,096,358 A 8/2000 Murdick
6,131,754 A 10/2000 Smelko
6,139,931 A 10/2000 Finkelstein
6,158,632 A 12/2000 Ekkert
6,194,042 B1 2/2001 Finkelstein
6,290,801 B1 9/2001 Krampe
6,312,776 B1 11/2001 Finkelstein
6,378,715 B1 4/2002 Finkelstein
6,458,302 B1 10/2002 Shifflet
6,548,302 B1 4/2003 Mao
6,602,309 B2 8/2003 Vizulis
6,627,273 B2 9/2003 Wolf
6,699,566 B2 3/2004 Zeiter
6,705,467 B1 3/2004 Kancsar
6,722,272 B2 4/2004 Jud
6,767,425 B2 7/2004 Meier
6,790,508 B2 9/2004 Razeti
6,866,926 B1 3/2005 Smelko
6,902,075 B2 6/2005 OBrien
6,916,516 B1 7/2005 Gerber
6,955,736 B2 10/2005 Rosenberger
6,974,045 B1 12/2005 Trombach
7,128,210 B2 10/2006 Razeti
7,182,475 B2 2/2007 Kramer
7,217,454 B2 5/2007 Smelko
RE39,790 E 8/2007 Fuchs
7,316,760 B2 1/2008 Nageli
7,448,153 B2 11/2008 Maliner
7,531,228 B2 5/2009 Perre
7,648,764 B2 1/2010 Yousif
7,713,605 B2 5/2010 Yousif
7,740,730 B2 6/2010 Schedl
7,740,927 B2 6/2010 Yousif
7,789,262 B2 9/2010 Niederer
7,798,359 B1 9/2010 Marsella
7,819,266 B2 10/2010 Ross
7,838,109 B2 11/2010 Declerck
7,850,033 B2 12/2010 Thorstensen-Woll
8,057,896 B2 11/2011 Smelko
8,129,009 B2 3/2012 Morris
8,308,003 B2 11/2012 O'Brien
8,329,288 B2 12/2012 Allegaert
8,348,082 B2 1/2013 Cain
8,906,185 B2 12/2014 McLean
9,028,963 B2 5/2015 Thorstensen-Woll
9,102,438 B2 8/2015 Thorstensen-Woll
9,221,579 B2 * 12/2015 Thorstensen-Woll . B65D 17/50
9,227,755 B2 * 1/2016 Thorstensen-Woll . B65D 17/50
9,440,765 B2 * 9/2016 Thorstensen-Woll . B65D 17/50
2001/0031348 A1 10/2001 Jud
2002/0068140 A1 6/2002 Finkelstein
2003/0087057 A1 5/2003 Blemberg
2003/0168423 A1 9/2003 Williams
2003/0196418 A1 10/2003 O'Brien
2004/0043238 A1 3/2004 Wuest
2004/0109963 A1 6/2004 Zaggia
2005/0048307 A1 3/2005 Schubert
2005/0208242 A1 9/2005 Smelko
2005/0208244 A1 9/2005 Delmas
2005/0218143 A1 10/2005 Niederer
2006/0000545 A1 1/2006 Nageli
2006/0003120 A1 1/2006 Nageli
2006/0003122 A1 1/2006 Nageli
2006/0124577 A1 6/2006 Ross
2006/0151415 A1 7/2006 Smelko
2006/0278665 A1 12/2006 Bennett
2007/0003725 A1 1/2007 Yousif
2007/0065609 A1 3/2007 Korson
2007/0267304 A1 11/2007 Portier
2007/0298273 A1 12/2007 Thies
2008/0026171 A1 1/2008 Gullick
2008/0073308 A1 3/2008 Yousif
2008/0103262 A1 5/2008 Haschke
2008/0145581 A1 6/2008 Tanny
2008/0156443 A1 7/2008 Schaefer
2008/0169286 A1 7/2008 McLean
2008/0231922 A1 9/2008 Thorstensen-Woll
2008/0233339 A1 * 9/2008 Thorstensen-Woll . B65D 51/20 428/99
2008/0233424 A1 9/2008 Thorstensen-Woll

(56) References Cited

U.S. PATENT DOCUMENTS

| | | | |
|---|---|---|---|
| 2009/0078671 | A1 | 3/2009 | Triquet |
| 2009/0208729 | A1 | 8/2009 | Allegaert |
| 2009/0304964 | A1 | 12/2009 | Sachs |
| 2010/0009162 | A1 | 1/2010 | Rothweiler |
| 2010/0030180 | A1 | 2/2010 | Deckerck |
| 2010/0047552 | A1 | 2/2010 | McLean |
| 2010/0059942 | A1 | 3/2010 | Rothweiler |
| 2010/0116410 | A1 | 5/2010 | Yousif |
| 2010/0155288 | A1 | 6/2010 | Harper |
| 2010/0170820 | A1 | 7/2010 | Leplatois |
| 2010/0193463 | A1 | 8/2010 | OBrien |
| 2010/0213193 | A1 | 8/2010 | Helmlinger |
| 2010/0221483 | A1 | 9/2010 | Gonzalez Carro |
| 2010/0290663 | A1 | 11/2010 | Trassl |
| 2010/0314278 | A1 | 12/2010 | Fonteyne |
| 2011/0000917 | A1 | 1/2011 | Wolters |
| 2011/0005961 | A1 | 1/2011 | Leplatois |
| 2011/0089177 | A1 | 4/2011 | Thorstensen-Woll |
| 2011/0091715 | A1 | 4/2011 | Rakutt |
| 2011/0100949 | A1 | 5/2011 | Grayer |
| 2011/0100989 | A1* | 5/2011 | Cain ..... B29C 65/76 220/270 |
| 2011/0138742 | A1 | 6/2011 | McLean |
| 2011/0147353 | A1 | 6/2011 | Kornfeld |
| 2012/0000910 | A1 | 1/2012 | Ekkert |
| 2012/0043330 | A1 | 2/2012 | McLean |
| 2012/0067896 | A1 | 3/2012 | Daffner |
| 2012/0103988 | A1 | 5/2012 | Wiening |
| 2012/0111758 | A1 | 5/2012 | Lo |
| 2012/0241449 | A1 | 9/2012 | Frischmann |
| 2013/0020324 | A1 | 1/2013 | Thorstensen-Woll |
| 2013/0121623 | A1 | 5/2013 | Lyzenga |
| 2013/0177263 | A1 | 7/2013 | Duan |
| 2014/0001185 | A1 | 1/2014 | McLean |
| 2014/0061196 | A1 | 3/2014 | Thorstensen-Woll |
| 2014/0186589 | A1 | 7/2014 | Chang |
| 2014/0224800 | A1 | 8/2014 | Thorstensen-Woll |

FOREIGN PATENT DOCUMENTS

| | | | |
|---|---|---|---|
| BR | 8200231 | U | 9/2003 |
| BR | 0300992 | A | 11/2004 |
| CA | 2015992 | A1 | 1/1991 |
| CA | 2203744 | | 10/1997 |
| CN | 1301289 | A | 6/2001 |
| DE | 10200603011 | B3 | 5/2007 |
| DE | 10204281 | A1 | 8/2007 |
| DE | 102007022935 | B4 | 4/2009 |
| DE | 202009000245 | U1 | 4/2009 |
| EP | 0668221 | A1 | 8/1995 |
| EP | 0826598 | A2 | 3/1998 |
| EP | 0826599 | A2 | 3/1998 |
| EP | 0905039 | A1 | 3/1999 |
| EP | 0717710 | B1 | 4/1999 |
| EP | 0915026 | A1 | 5/1999 |
| EP | 0706473 | B1 | 8/1999 |
| EP | 1075921 | | 2/2001 |
| EP | 1199253 | | 4/2002 |
| EP | 0803445 | B1 | 11/2003 |
| EP | 1462381 | A1 | 9/2004 |
| EP | 1199253 | B1 | 3/2005 |
| EP | 1577226 | A1 | 9/2005 |
| EP | 1814744 | A1 | 8/2007 |
| EP | 1834893 | A1 | 9/2007 |
| EP | 1837288 | A1 | 9/2007 |
| EP | 1839898 | A1 | 10/2007 |
| EP | 1839899 | A1 | 10/2007 |
| EP | 1857275 | A1 | 11/2007 |
| EP | 1873078 | A1 | 1/2008 |
| EP | 1445209 | B1 | 5/2008 |
| EP | 1918094 | A1 | 5/2008 |
| EP | 1935636 | | 6/2008 |
| EP | 1968020 | A1 | 9/2008 |
| EP | 1992476 | A1 | 11/2008 |
| EP | 2014461 | | 1/2009 |
| EP | 2230190 | A1 | 9/2010 |
| EP | 2292524 | A1 | 3/2011 |
| FR | 2916157 | A1 | 11/2008 |
| FR | 2943322 | A1 | 9/2010 |
| GB | 2501967 | A | 11/2013 |
| JP | H09110077 | A | 4/1997 |
| KR | 100711073 | B1 | 4/2007 |
| KR | 100840926 | B1 | 6/2008 |
| KR | 100886955 | B1 | 3/2009 |
| MX | 05002905 | A | 2/2006 |
| MX | 2010001867 | A | 4/2010 |
| WO | 9905041 | A1 | 2/1999 |
| WO | 2000066450 | | 11/2000 |
| WO | 2006018556 | A1 | 2/2006 |
| WO | 2006021291 | A1 | 3/2006 |
| WO | 2006073777 | A1 | 7/2006 |
| WO | 2006108853 | A1 | 10/2006 |
| WO | 2008027029 | A2 | 3/2008 |
| WO | 2008027036 | A1 | 3/2008 |
| WO | 2008039350 | A2 | 4/2008 |
| WO | 2008118569 | A2 | 10/2008 |
| WO | 2008125784 | A1 | 10/2008 |
| WO | 2008125785 | A1 | 10/2008 |
| WO | 2008148176 | A1 | 12/2008 |
| WO | 2009092066 | A2 | 7/2009 |
| WO | 2010115811 | A1 | 10/2010 |
| WO | 2011039067 | A1 | 4/2011 |
| WO | 2012079971 | A1 | 6/2012 |
| WO | 2012113530 | A1 | 8/2012 |
| WO | 2012152622 | A1 | 11/2012 |
| WO | 2012172029 | A1 | 12/2012 |
| WO | 2015119988 | | 8/2015 |

* cited by examiner

INNER SEAL WITH A SUB TAB LAYER

CROSS-REFERENCE TO RELATED APPLICATION

This application is a continuation of prior application Ser. No. 14/208,106, filed Mar. 13, 2014, which claims benefit of U.S. Provisional Application No. 61/791,788, filed Mar. 15, 2013.

FIELD

The disclosure relates to a pull-tab sealing member for closing the mouth of a container, and more particularly, to a pull-tab sealing member having a tab formed with a sub tab layer under the pull-tab.

BACKGROUND

It is often desirable to seal the opening of a container using a removable or peelable seal, sealing member, or inner seal. Often a cap or other closure is then screwed or placed over the container opening capturing the sealing member therein. In use, a consumer typically removes the cap or other closure to gain access to the sealing member and removes or otherwise peels the seal from the container in order to dispense or gain access to its contents.

Initial attempts at sealing a container opening included an induction- or conduction-type inner seal covering the container's opening where the seal generally conformed to the shape of the opening such that a circular container opening was sealed with a round disk approximately the same size as the opening. These prior seals commonly had a lower heat activated sealing layer to secure a periphery of the seal to a rim or other upper surface surrounding a container's opening. Upon exposing the seal to heat, the lower layer bonded to the container rim. In many cases, these seals included a foil layer capable of forming induction heat to activate the lower heat seal layer. These prior seals tended to provide good sealing, but were often difficult for a consumer to remove because there was nothing for the consumer to grab onto in order to remove the seal. Often, the consumer needed to pick at the seal's edge with a fingernail because there was little or no seal material to grasp.

Other types of seals for containers include a side tab or other flange that extended outwardly from a peripheral edge of the seal. These side tabs are generally not secured to the container rim and provide a grasping surface for a consumer to hold and peel off the seal. These side tabs, however, extend over the side of the container rim and often protrude into a threaded portion of the closure. If the side tab is too large, this configuration may negatively affect the ability of the seal to form a good heat seal. The side tabs (and often the seal itself) can be deformed or wrinkled when the closure or other cap is placed on the container due to contact between the closure (and threads thereof) and tabbed part of the seal. To minimize these concerns, the side tabs are often very small; thus, providing little surface area or material for a consumer to grasp in order to remove the seal.

Yet other types of seals include a sealing member having a tab defined on the top of the seal. One approach of these prior seals includes a partial layer of coated pressure sensitive adhesive to secure the tab to a layer of metal foil. The tab was formed by a full layer extending across the entire surface of the sealing member, but the full layer was only bonded to half of the seal to form the tab. This type of top-tabbed seal offered the advantage of a larger tab, which provided more grasping area for the consumer to hold and peel off the seal, but required a full additional layer of material in order to form the tab. In other approaches, the seal may include a tab formed from the additional full layer of film combined with an additional full layer of adhesive utilizing a part paper or part polymer layer, called a tab stock, to form the tab. This part layer is inserted between the additional full layer of adhesive and lower seal portions to prevent the tab from sticking to the layers below, which formed the tab. In all the prior types of top-tabbed-like seals, the gripping tab was formed by a full layer of material (or a full layer of material and a full layer of adhesive) that extended across the entire surface of the seal.

DETAILED DESCRIPTION

Figure 1:
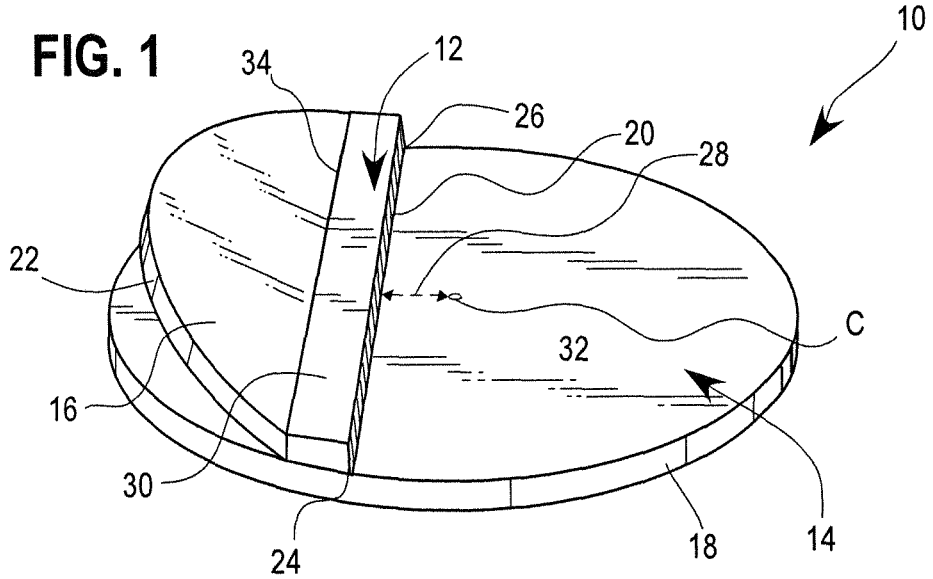
FIG. 1 is a perspective view of an exemplary tabbed sealing member.

A pull-tab sealing member for a container is described herein containing an upper laminate forming a pull-tab bonded to a lower laminate capable of being heat sealed to a container's mouth or opening. The upper laminate defines a pull tab wholly within a perimeter or circumference of the seal. The sealing member includes a sub tab layer underneath the tab and bonded to the lower laminate, but not bonded to the tab itself. This sub tab layer adds structural support to stabilize the sealing member and tab to aid in minimizing folding, wrinkles, creases, and the like. The sub tab layer can be coextensive with the tab or extend slightly beyond to tab, but not extend the full width or the full surface area of the seal. For instance, the sub tab layer may be coextensive with a tab stock or be coextensive with the full upper laminate or may be other sizes, less than the full sealing member, as needed. This sub tab layer can be particularly advantageous in seals with relatively thin lower laminates (such as 3 mils or less), but can be used in a wide variety of seals needing structural support with a tab. The sub tab layer may aid in providing concentric stability of the sealing member.

In some approaches and contrary to prior seals, the upper laminate does not extend the full width of the sealing member in order to define the gripping tab. The pull-tab sealing members herein combine the advantages of a tabbed sealing member with a large gripping tab defined completely within the perimeter of the seal, but achieve such functionality with less film and adhesive and permit such a tab structure to be formed on many different types of lower laminates. This partial upper laminate can be combined with the sub tab layer and additional upper layers (such as a full paper layer) as needed for particular applications. The upper laminate structure is advantageous, in some approaches, in seals for large or wide mouth containers, such as container with an opening from about 30 to about 100 mm, in some approaches, about 60 to about 100 mm, such as common 38 mm or 83 mm seals, but can be used with seals for any sized container.

In other approaches, the tab is formed by a full layer of material, such as a full layer of a polymer film (such as PET for example) combined with a partial layer of a composite polyester and upper and lower adhesives combined with the above mentioned sub tab. The sub tab is adhered to the lower laminate and not adhered to the upper laminate to enhance structural support.

In one aspect, the sealing members herein include a pull or grip tab defined in the upper laminate portion wholly within a perimeter or circumference of the sealing member wherein an upper surface of the sealing member is partially defined by the upper laminate portion and partially defined by the lower laminate portion. In one approach, the top surface of the sealing member is provided by a minor portion of the upper laminate and a major portion of the lower laminate. In other approaches, the lower laminate is exposed at a top surface of the seal, in some approaches, covering about 50 percent to about 75 percent (or more) of the upper surface of the entire seal. In some approaches, the seals herein allow consumers to remove the sealing member using the tab (as in a conventional pull-tab seal) or puncture the sealing member by piercing the exposed lower laminate portion to provide push/pull functionality depending on the preference of the consumer. Prior tabbed seals having a top-defined gripping tab via a full width film layer generally did not allow the functionality of easy piercing because the additional full layers used to form the tab rendered the seal too difficult to pierce.

In other aspects, the seals of the present disclosure defining a tab wholly within a perimeter or circumference of the seal (but formed by a partial layer) provide an improved ability for the tabbed sealing member to function in a two-piece seal and liner combination. In a two-piece seal and liner combination, the tabbed sealing member is temporarily adhered across its upper surface to a liner. After container opening and removal of a cap or closure, the sealing member stays adhered to the container mouth and the liner separates and remains in the container's cap.

In some prior versions of this type of seal, the bottom layer of the sealing member is a heat seal layer that is activated by heating, such as by induction or conduction heating, in order to adhere or bond an outer periphery of the sealing member to a rim surrounding the mouth of a container. In the two-piece seal and liner combination, an upper surface of the sealing member is temporarily adhered to a lower surface of the liner by a release layer, which is often a heat-activated release layer, such as an intervening wax layer. During heating to bond the sealing member to the container, heat not only activates the lower heat seal layer, but also travels upwardly through the seal to melt the intervening wax across the entire surface of the sealing member to separate the liner from the sealing member. Often, the melted wax is absorbed by the liner in order to permit easy liner separation from the sealing member. As can be appreciated, for this sealing member and liner combination to function properly, the intervening wax layer needs to be melted across the entire surface of the sealing member. If the wax is not melted evenly all the way across the sealing member upper surface, the liner may not properly separate from the lower seal portion.

As the prior tabbed seals required additional full layers of material (film and adhesive) to form the tab, these additional layers would tend to negatively affect heat transfer upwardly through the seal. This shortcoming of less upward heat transfer limits the ability of top-tabbed-type seals to be used in the two-component assembly because the required additional full layers of material (film and adhesive) to form the tab often led to issues with the proper melting the wax for liner separation.

These shortcomings of prior tabbed seals in the context of a two-piece liner and seal combinations tended to be even more pronounced in view of further shortcomings of typical induction heating equipment. In an induction seal, a metal foil is often included in the seal to generate heat for activation of the heat seal. This heat is generated due to the induction apparatus forming eddy currents in the foil layer. The induction heat from the foil melts the lower heat seal layer for bonding to the container rim. In a common two-piece assembly, the induction heating generated by the foil layer is also used to melt the intervening wax layer; however, the induction heating generated by the foil layer at the center of the seal is often lower than the induction heating generated by the foil at the periphery of the seal laminate. The center of the laminate is farthest away from the induction coil in the induction heating apparatus and the eddy currents in the foil are weakest at the center of the disk, which can form a cold spot in the center of the seal. This shortcoming tends to be further exaggerated in wide seals (such as those about 60 mm in diameter or larger or seals about 60 to about 100 mm across) because the center is much farther from the induction coil. Normally, such variation in induction heating between the edges of the seal laminate and the center is not an issue because heat is needed most at the seal's periphery for bonding to the container rim at the periphery of the seal laminates. In prior two-piece seals without tabs, there was less material to hinder the upwardly directed flow of heat. However, when attempting to use the tabbed seals in a two-piece liner and seal combination, the extra full layers forming the tab often created problems when attempting to use induction heat to melt the intervening wax layer, especially in the center of the seal where the induction heating was the lowest.

In some further approaches of the present disclosure, on the other hand, the tab is formed wholly within a perimeter of the sealing member, but the upper laminate and layers forming that tab are spaced from central portions and regions of the sealing member. In some approaches, the layers defining the tab in the upper laminate are provided by a circular segment that is less than a semicircle within of the sealing member's upper surface. As discussed more below, in some approaches, the upper laminate circular segment forming the tab is defined by a chord that does not extend through the center of the sealing member and the perimeter of the sealing member along its circumference between opposing endpoints of the chord. In this manner, the center and center portions of the seal are exposed to the lower laminate and free of the layers forming the tab (and upper laminate). This is advantageous in a two-piece assembly because it permits greater upwardly directed heat flow in the center portions of the seal to melt the intervening wax layer more easily than the prior tabbed seals.

For simplicity, this disclosure generally refers to a container or bottle, but the sealing members herein may be applied to any type of container, bottle, package or other apparatus having a rim or mouth surrounding an access opening to an internal cavity. In this disclosure, reference to upper and lower surfaces and layers of the components of the sealing member refers to an orientation of the components as generally depicted in figures and when the sealing member is in use with a container in an upright position and having an opening at the top of the container. Different approaches to the sealing member will first be generally described, and then more specifics of the various constructions and materials will be explained thereafter. It will be appreciated that the sealing members described herein, in some cases, function in both a one-piece or two-piece sealing member configuration. A one-piece sealing member generally includes just the sealing member bonded to a container rim. A cap or closure may be also used therewith. A two-piece sealing member includes the sealing member temporarily bonded to a liner. In this construction, the sealing member is bonded to a container's rim, and the liner is configured to separate from the sealing member during heating to be retained in a cap or other closure used on the container. In a two-piece construction, a wax layer, for example, may be used to temporarily bond the sealing member to a liner. Other types of releasable layers may also be used to provide a temporary bond between the seal and liner, but the releasable layers are generally heat activated.

Figure 2:
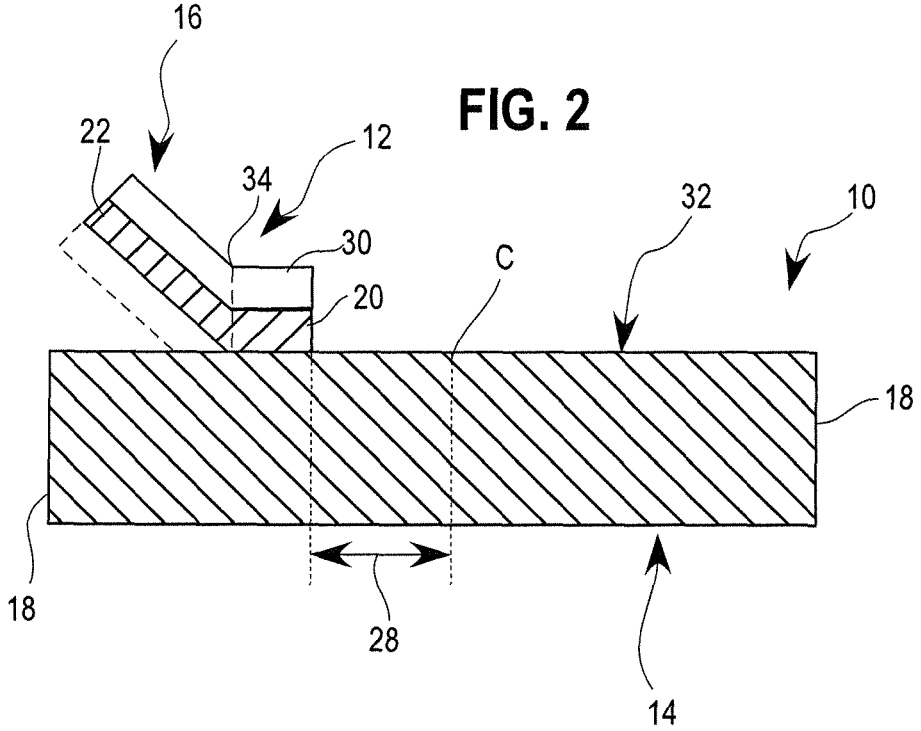
FIG. 2 is a cross-sectional view of another exemplary sealing member.

Turning to more of the specifics, FIGS. 1 and 2 generally show a tabbed seal 10 having an upper laminate 12 and a lower laminate 14. The upper laminate 12 defines a grip tab 16 wholly within a circumference or perimeter 18 of the seal 10. By one approach, the upper laminate 12 is formed by one or more layers of adhesive and/or film where all layers forming the upper laminate 12 and the defined grip tab 16 extend only partway across an upper or major surface of the lower laminate 14. In one form, the upper laminate 12 forms a circular segment defined by edges of the upper laminate 12 where one edge 20 is a chord of the seal 10 and another edge 22 is a segment extending along the perimeter or circumference 18 between opposing chord endpoints 24 and 26. As shown in the exemplary approach of FIGS. 3 and 4, the upper laminate, circular segment 12 is spaced a distance 28 from the center C of the seal 10. In this manner, the center portions or regions of the seal 10 are free of the upper laminate 12. In some approaches, an upper surface 32 of the lower laminate 14 is exposed for at least about 50 percent and, in some cases, greater than half of the sealing member 10. In other approaches, the upper surface 32 of the lower laminate 14 is exposed for about 50 to about 75 percent of the sealing member's upper total surface area.

The circular segment forming the upper laminate 12 includes the tab portion 16, which is free to pivot upwardly at a pivot line 34 because the tab 16 is not adhered to the lower laminate 14. The circular segment forming the upper laminate 12 also includes an adhered portion 30 that is directly bonded to the lower laminate 14. The adhered portion 30 extends between the pivot line 34 and segment chord 20. In some approaches (turning to FIG. 9 for a moment), the adhered portion 30 of the upper laminate circular segment 12 may have a length or height H1 that is about 30 to about 75 percent of the total length or height H of the upper laminate circular segment laminate 12 and, in other approaches, about 40 to about 60 percent of the laminate 12, and in yet other approaches, about 30 to about 40 percent of the laminate 12 and still provides a strong bond so that the tab 16 may be used to pull the sealing member 10 from a container rim in one piece. The tab 16 of the upper laminate circular segment 12 has a height or length H2 being the remainder of the upper laminate circular segment 12, and in some cases the tab 16 is the majority of the segment 12. In another approach, the circular segment 12 may define a ratio of tab 16 to adhered portion 30 of about 1:1 to about 2.5:1 and, in other approaches, may be about 1.1 to about 2.1:1.

The lower laminate 14 is not particularly limited and can be any single or multiple layer film structure, sheet, or laminate as needed for a particular application. For instance, lower laminate 14 may be from about 1 mil to about 20 mils thick, and in some approaches, about 7 to about 10 mils thick. In some approaches, however, particular laminate structures of the lower laminate 14 are more advantageous for certain applications. FIGS. 3-7 provide examples of various forms suitable the lower laminate 14.

Figure 3:
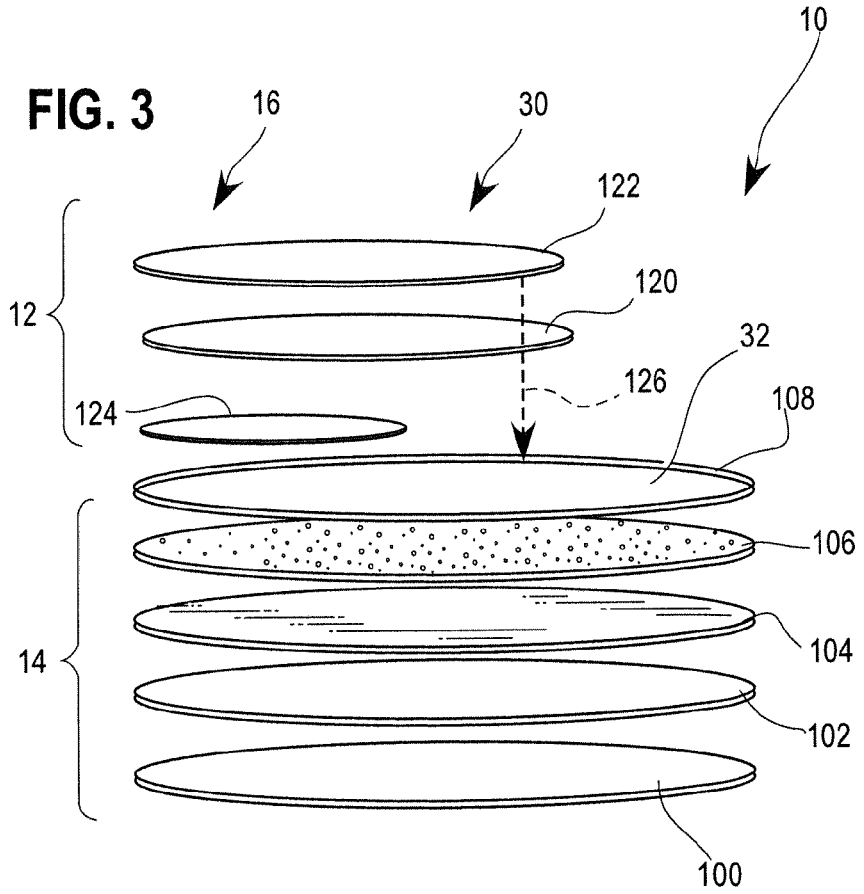
FIG. 3 is an exploded perspective view of another exemplary sealing member.
Figure 4:
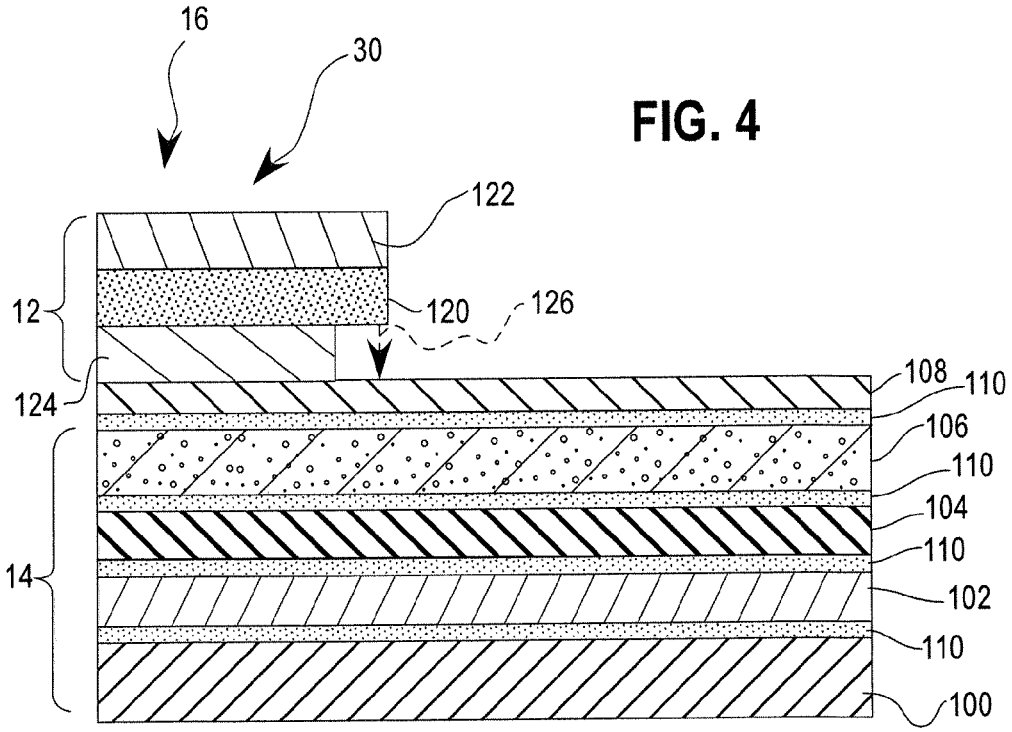
FIG. 4 is a cross-sectional view of another exemplary sealing member.

In FIGS. 3 and 4, another example of a seal 10 is provided. In this approach, the lower laminate 14 may include, from bottom to top, a lower sealant or heat seal layer 100, a polymer film support layer 102 above and over the seal layer 100, a membrane or an induction heatable layer 104 above the support layer. On top of the membrane layer 104 may be an insulation layer or heat redistribution 106 and an optional top polymer support layer 108. Each of these layers will be described more below.

The lower sealant or heat seal layer 100 may be composed of any material suitable for bonding to the rim of a container, such as but not limited to induction, conduction, or direct bonding methods. Suitable adhesives, hot melt adhesives, or sealants for the heat sealable layer 100 include, but are not limited to, polyesters, polyolefins, ethylene vinyl acetate, ethylene-acrylic acid copolymers, surlyn, and other suitable materials. By one approach, the heat sealable layer may be a single layer or a multi-layer structure of such materials about 0.2 to about 3 mils thick. By some approaches, the heat seal layer is selected to have a composition similar to and/or include the same polymer type as the composition of the container. For instance, if the container contains polyethylene, then the heat seal layer would also container polyethylene. If the container contains polypropylene, then the heat seal layer would container polypropylene. Other similar materials combinations are also possible.

Support layer 102 may be optional in the laminate 114. If included, it may be polyethylene terephthalate (PET), nylon, or other structural polymer layer and may be, in some approaches, about 0.5 to about 1 mil thick.

Next, the membrane layer 104 may be one or more layers configured to provide induction heating and/or barrier characteristics to the seal 10. A layer configured to provide induction heating is any layer capable of generating heat upon being exposed to an induction current where eddy currents in the layer generate heat. By one approach, the membrane layer may be a metal layer, such as, aluminum foil, tin, and the like. In other approaches, the membrane layer may be a polymer layer in combination with an induction heating layer. The membrane layer may also be or include an atmospheric barrier layer capable of retarding the migration of gases and moisture at least from outside to inside a sealed container and, in some cases, also provide induction heating at the same time. Thus, the membrane layer may be one or more layers configured to provide such functionalities. By one approach, the membrane layer is about 0.3 to about 2 mils of a metal foil, such as aluminum foil, which is capable of providing induction heating and to function as an atmospheric barrier.

Layer 106 may be an insulation layer or a heat-redistribution layer. In one form, layer 106 may be a foamed polymer layer. Suitable foamed polymers include foamed polyolefin, foamed polypropylene, foamed polyethylene, and polyester foams. In some forms, these foams generally have an internal rupture strength of about 2000 to about 3500 g/in. In some approaches, the foamed polymer layer 106 may also have a density less than 0.6 g/cc and, in some cases, about 0.4 to less than about 0.6 g/cc. In other approaches, the density may be from about 0.4 g/cc to about 0.9 g/cc.

In other approaches, the layer 106 may be a non-foam heat distributing or heat re-distributing layer. In such approach, the non-foam heat distributing film layer is a blend of polyolefin materials, such as a blend of one or more high density polyolefin components combined with one or more lower density polyolefin components. Suitable polymers include but are not limited to, polyethylene, polypropylene, ethylene-propylene copolymers, blends thereof as well as copolymers or blends with higher alpha-olefins. By one approach, the non-foam heat distributing polyolefin film layer is a blend of about 50 to about 70 percent of one or more high density polyolefin materials with the remainder being one or more lower density polyolefin materials. The blend is selected to achieve effective densities to provide both heat sealing to the container as well as separation of the liner from the seal in one piece.

When used in the seal 10, effective densities of the non-foam heat distributing polyolefin layer 106 may be between about 0.96 g/cc to about 0.99 g/cc. Above or below this density range, unacceptable results are obtained because the layer provides too much insulation or does not effectively distribute heat. By another approach, the non-foam heat distributing layer is a blend of about 50 to about 70 percent high density polyethylene combined with low to medium density polyethylene effective to achieve the density ranges described above.

In addition, effective thicknesses of the non-foam heat distributing layer are selected to achieve such performance in combination with the density. One approach of an effective thickness may be about 2 to about 10 mils. In other approaches, layer 106 may be about 2 to about 5 mils thick, in other approaches, about 2 to about 4 mils thick, and in yet other approaches, about 2 to about 3 mils thick. Thicknesses outside this range tend to be unacceptable for heat redistribution because the layer does not provide enough insulation or does not effectively distribute heat as needed to achieve the dual performance characteristics of liner separation and seal member bonding.

On top of the lower laminate 14 is an optional, outer polymer support layer 108, which may be PET, nylon, or other structural-type polymer layer(s). In one form, layer 108 is an asymmetrical polyester film having an upper layer of an amorphous polyester and a lower layer of a crystallized polyester layer. The amorphous polyester layer may have a lower melting point than the crystallized polyester and may aid in achieving a good bond with the upper laminate 12 and improve processing over hot rollers and other equipment during seal manufacture. In one approach, the layer 108 is a co-extruded layer with the crystallized layer being thicker than the amorphous layer. In the seal, the amorphous layer may form the bond with the upper laminate 12 and form the upper surface 32 of the lower laminate 14. The upper laminate 14 may also include other layers as needed for a particular application, which may be layers in between the various layers discussed herein as appropriate for a particular application.

Turning to FIG. 4 for a moment, each of the layers of FIG. 3 may also be bonded to the layer adjacent to it via an optional adhesive layer 110. These adhesive layers may be same, as shown in the exemplary seal of FIG. 4, but may also be different in composition. The adhesives useful for any of the optional adhesive layers described herein include, for example, ethylene vinyl acetate (EVA), polyolefins, 2-component polyurethane, ethylene acrylic acid copolymers, curable two part urethane adhesives, epoxy adhesives, ethylene methacrylate copolymers and the like bonding materials. Other suitable materials may include low density polyethylene, ethylene-acrylic acid copolymers and ethylene methacrylate copolymers. By one approach, any optional adhesive layers may be a coated polyolefin adhesive layer. If needed, such adhesive layers may be a coating of about 0.2 to about a 0.5 mil (or less) adhesive, such coated ethylene vinyl acetate (EVA), polyolefins, 2-component polyurethane, ethylene acrylic acid copolymers, curable two part urethane adhesives, epoxy adhesives, ethylene methacrylate copolymers and the like bonding materials.

Turning back to FIG. 3, one approach of the circular segment portion forming the upper laminate 12 will be described further. In this approach, the laminate 12 includes a layer of heat activated adhesive or a heat activated bonding layer 120 and a corresponding or overlapping upper polymer support layer 122 where the adhesive layer 120 partially bonds 126 the support layer 122 to the upper surface 32 of the lower laminate 14 to form both the tab portion 16 and the bonded portion 30. The upper polymer support layer 122 may be PET, nylon, or other structural-type polymer layer (s).

In the approach of FIG. 3, the upper laminate also includes a partial layer 124, which is shorter or smaller than layers 120 and 122 of the laminate 112, and called a tab stock. The tab stock 124 is adhered or bonded to the adhesive layer 120 on a top surface thereof, but is not bonded to the lower laminate 14 in the final assembly. However, in optional approaches, the tab 16 may also be formed without a tab stock 124 and, instead, utilize a part layer of adhesive corresponding only to the bond area 30. (This optional way of forming the tab 16 may be utilized on any of the seal approaches described herein.)

When using the tab stock 124, the tab 16 is defined or formed via the tab stock 124 that extends only part way across the upper laminate 12. More specifically, the tab stock 124 forms the tab 16 because it bonds to the heat-activated bonding layer 120 and generally prevents layer 122 (and any layers above) from adhering to the upper surface 32 of the lower seal laminate 14 across at least a portion thereof as generally shown in FIGS. 3 and 4. That is, a top surface of the tab stock 124 is adhered to a lower portion of the heat-activated bonding layer 120. A bottom surface of tab stock 124 is adjacent to, but not bonded to, the upper surface 32 of the lower laminate 14 to form the tab 16. In one aspect, the tab stock 124 is formed of polyester, such as polyethylene terephthalate (PET), or paper. By one optional approach, a lower surface of the tab stock 124 may be coated with a release material, for example silicone. The optional release coating minimizes the possibility that the tab stock 124 will become adhered to the upper surface 32 of the lower laminate 14 during the heat sealing or induction heat sealing process. However, such release coatings are not typically necessary. As generally shown in at least FIGS. 3 and 4, the tab stock 124 permits the tab structure 16 to pivot or hinge upwardly along a boundary line 34 to form the tab 16. By this approach, the tab stock 124 and formed tab 16 are defined wholly within a circumference or perimeter 22 of the seal.

The heat-activated bonding layer 120 may include any polymer materials that are heat activated to achieve its bonding characteristics. By one approach, the heat-activated bonding layer may have a density of about 0.9 to about 1.0 g/cc and a peak melting point of about 145° F. to about 155° F. A melt index of the bonding layer 120 may be about 20 to about 30 g/10 min (ASTM D1238). Suitable examples include ethylene vinyl acetate (EVA), polyolefin, 2-component polyurethane, ethylene acrylic acid copolymers, curable two-part urethane adhesives, epoxy adhesives, ethylene methacrylate copolymers and the like bonding materials. As shown, the heat activated bonding layer 120 extends the full width of the laminate segment 12 (but not the full width or length of the entire seal 10 or the entire lower laminate 14). In other approaches, the laminate 12 may only include a partial layer of adhesive and, thus, not use the tab stock layer 124 discussed above.

By one approach, the heat-activated bonding layer 120 is EVA with a vinyl acetate content of about 20 to about 28 percent with the remaining monomer being ethylene in order to achieve the bond strengths in order to securely hold the upper laminate to the lower laminate. A vinyl acetate content lower than 20 percent is insufficient to form the robust structures described herein. By one approach, bonding layer 120 may be about 0.5 to about 1.5 mil of EVA and, in other approaches, about 0.5 to about 1.0 mils of EVA; however, the thickness can vary as needed for a particular application to achieve the desired bonds and internal strength.

Figure 5:
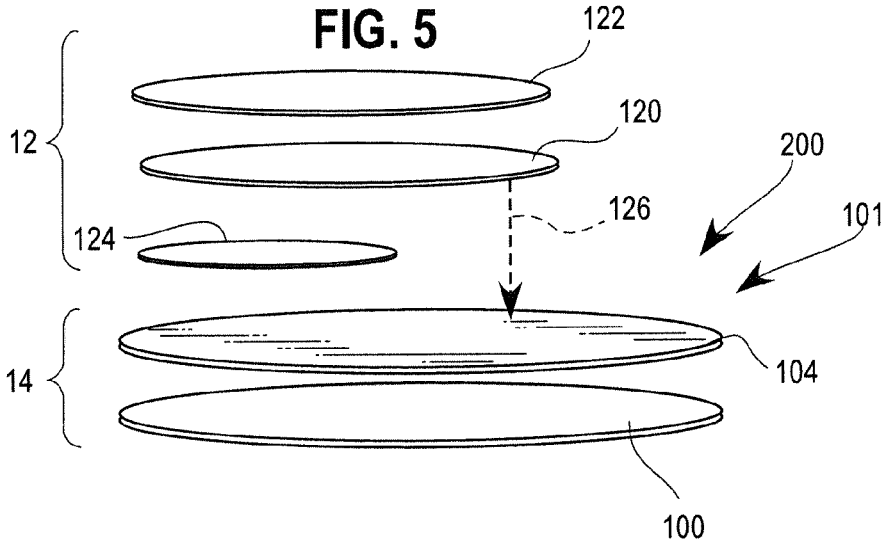
FIG. 5 is an exploded perspective view of another exemplary sealing member.
Figure 6:
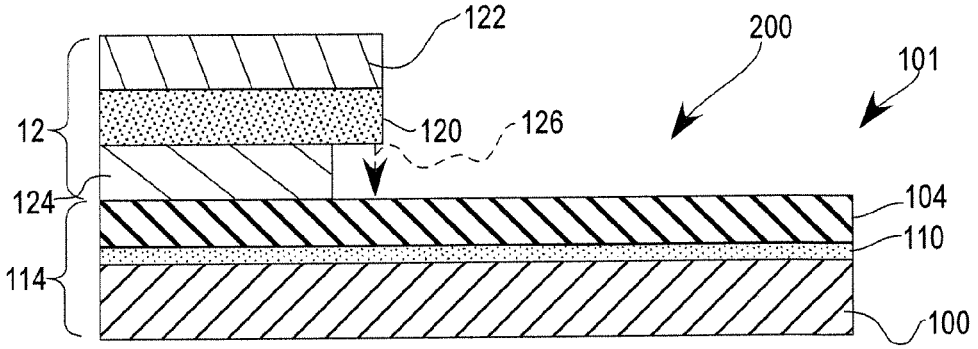
FIG. 6 is a cross-sectional view of another exemplary sealing member.

FIGS. 5 and 6 show yet another alternative approach of a sealing member 101 described herein. In this approach, a lower laminate 114 includes just a lower sealant or heat seal layer 100 combined with a membrane layer 104 bonded together with an optional adhesive layer 110. The upper laminate 12 or segment may also include similar layers as the version discussed above. To this end, the segment 12 may include an upper polymer support 122, a heat activated bonding layer 120, and the tab stock 124. The composition of these layers is similar to the version discussion above and will not be discussed further. In this approach, the lower laminate may be from about 1 to about 5 mils thick, and in other approaches, about 1 to about 3 mils thick.

Figure 7:
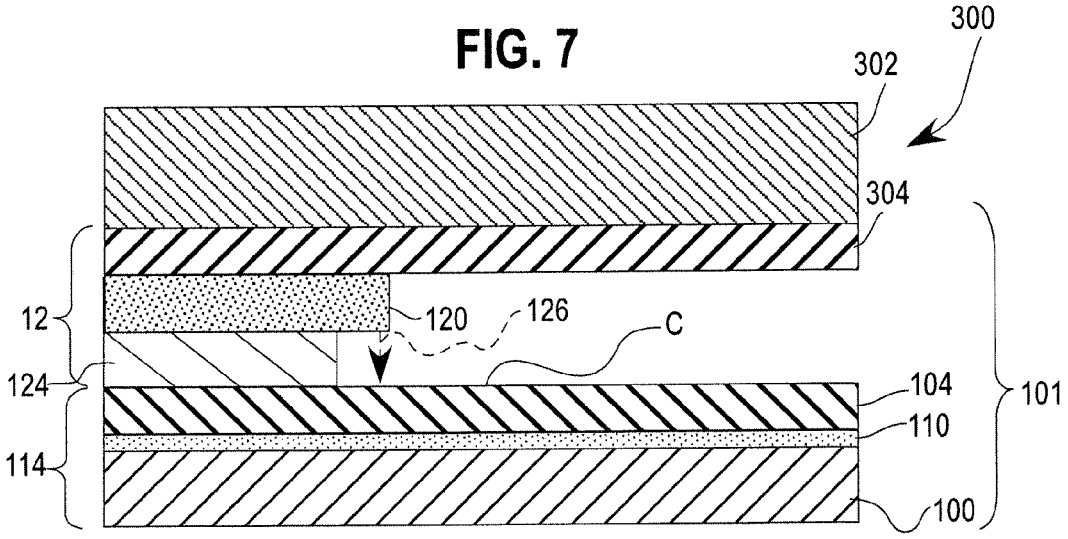
FIG. 7 is a cross-sectional view of another exemplary sealing member temporarily bonded to a liner via a wax or other release layer.
Figure 8:
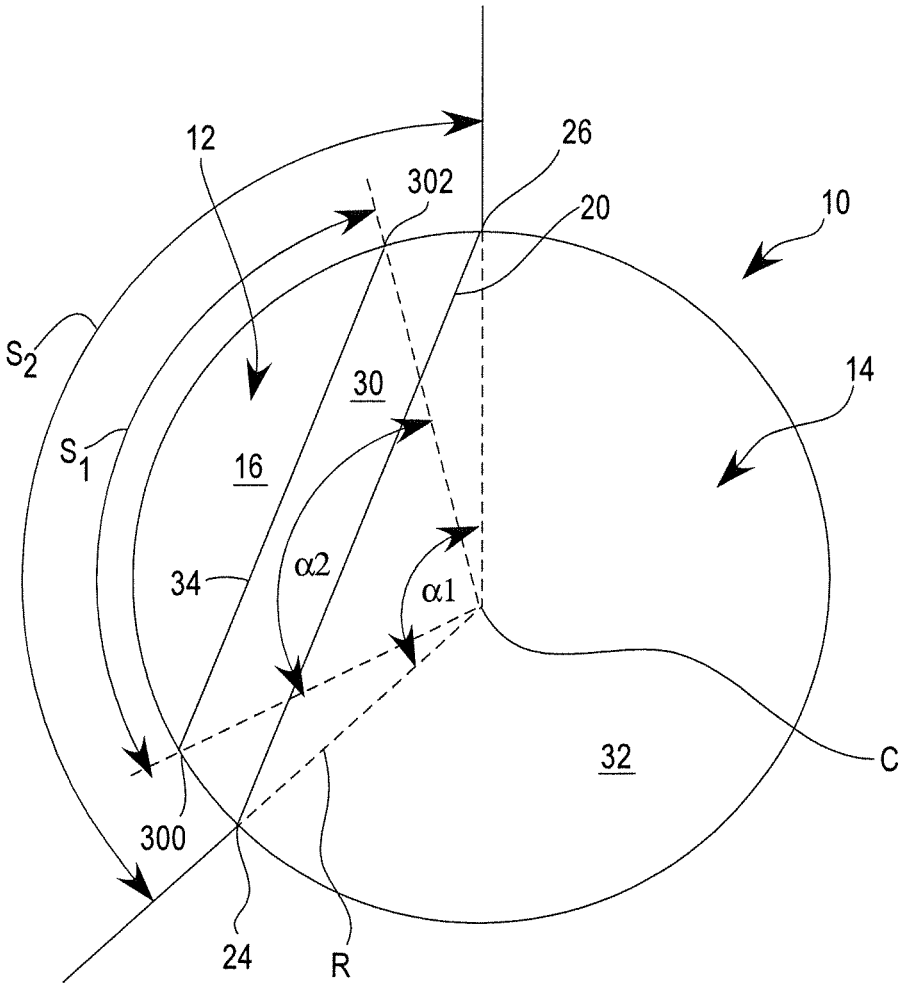
FIGS. 8 and 9 are top plan views of exemplary tabbed sealing members.

The approach of FIGS. 5 and 6 is advantageous because it presents an exposed membrane layer (often a foil layer) as a portion of, and in some cases, the majority of the top surface of the sealing member 101. Additionally, in view of the relatively thin laminate 114, the sealing member 101 can be opened by either a consumer pulling on the tab 16 to peel the sealing member from the container rim or, alternatively, exposed portions 200 of the seal (that is, the portions of the seal not covered by the upper laminate segment 12) can easily be punched through or pierced by a consumer. This enables push/pull functionality to the seal—that is, push or pierce through the lower laminate 14 and pulling of the tab 16 to peel the seal 10 from the container. FIG. 7 shows an approach with the tab stock 124 formed from a PET layer while FIG. 8 shows an alternative approach with the tab stock 124 formed from a paper layer.

FIG. 7 illustrates the seal of FIG. 5 or 6 in an exemplary two-piece seal and liner assembly 300. The other seals described herein may also be used in a similar arrangement. In this approach, a top surface of the sealing member 101 is temporarily bonded to a liner 302 shown as an optional pulp backing in FIG. 7. The liner 302 is temporarily adhered to seal 101 via an intermediate layer 304, which in this approach, is a heat-activated layer of wax or microcrystalline wax. Prior to heat sealing (by induction, conduction, or the like) to a container rim, the wax layer 304 bonds the liner 302 to the seal 101. As part of the heating process to bond the seal 101 to a container, heat (in some approaches, induction heating from the metal layer) flows upwardly in the seal and activates or melts the wax 304 to release the bond between the liner 302 and the sealing member 101, which separates the two components. In some approaches, the wax is melted and absorbed by the liner 302.

As can be appreciated, for this separation to occur cleanly and properly, the wax needs to melt across the entire surface area of the seal 101. With prior seals, such as those in FIGS. 1 and 2 having a full layer of film and in some cases a full layer of adhesive, there was additional material at the center portion of the seal that the upwardly directed heat needed to transfer through. As the center portions of the seal are farthest from the induction coils and, thus, generating the lowest levels of induction heat, the center of the seal was previously prone to not generating sufficient heating in a two-component assembly when an upper laminate included full layers forming the tab. This poor central upwards heat transfer was often made worse if the seal had an insulation layer that further limited upward heat transfer, or if the seal was large (such as about 60 mm or greater).

The seal of FIG. 7, for example, eliminates the additional tab forming layers at the center and central portions of the seal 101 so that these areas with the weakest eddy currents in induction sealing do not need to generate high levels of heat to flow through additional layers of material in order to reach and melt the center wax areas. Thus, the seal of FIG. 7 provides and improved two-piece seal and liner assembly even with a tab defined wholly within a perimeter or circumference of the seal. Moreover, because the center of the seal is exposed, the upper laminate 12 can be thicker than normally used in tabbed seals and, in some approaches, be greater than about 5 mils, and in other approaches be about 5 to about 10 mils thick. This layer can also include other structural support layers without the problem of hindering upwardly directed heat flow. To this end, laminate 12 may include thick polymer and/or thick foam layers to improve tab rigidity.

In some approaches, the liner 302 can be formed of one or more layers of cardboard, pulp board, or a synthetic compressing agent (such as a synthetic foam or synthetic fibers) that is effective for absorbing the release layer 304, such as wax, upon being activated by heating. In one approach, the liner 302 may include a layer of foamed plastic material to which a paper layer (not shown) has been adhered to a bottom surface thereof. In this approach, the paper layer is the layer in contact with the release layer 304 for absorbing the molten wax or other activated components thereof. By another approach, the liner 302 may have a thickness in the range from about 400 to about 1800 microns. Synthetic foam or fibers may also be useful as materials or the liner if they are formed into a layer with a suitable compression factor comparable to pulp board of the type traditionally used in induction seals. For example, low density polyethylene (LDPE), coextruded LDPE, polypropylene (PP), and polystyrene (PS) foam or fibers may also be used as the liner. The synthetic material selected should have a sufficient absorbency, suitable pore volume, and structure to absorb substantially all of the wax used in the seal. The dimensions of the compressing agent absorbing material will vary according to the application and the size of the opening of the container and size and construction of the closure being used.

By one approach, the release layer 304 may be a wax layer. The wax may include any suitable wax material which will melt within the temperature range to which the sealing member is to be subjected by an energy source during the induction sealing process. For example, the wax layer may include paraffin, microcrystalline waxes, and blends thereof. By one approach, the wax layer may comprise a blend of paraffin wax and microcrystalline wax wherein the proportion of microcrystalline wax used in the wax layer is adjusted to provide the wax layer being formulated to enhance the ability of the wax to be absorbed by the liner. Alternatively, the wax layer may include microcrystalline wax modified with other polymeric additives to enhance its initial bonding properties. For instance, the wax layer may comprise microcrystalline wax modified with at least one of ethylene vinyl acetate and polyisobutylene.

In general, the application of induction energy to the sealing member heats the membrane layer 104 to a temperature, in some approaches, from about 300 to about 450° F. The volume or thickness of the wax layer, therefore, should be selected such that substantially all of the wax will melt during the manufacturing process and be absorbed by the compressing agent.

Figure 9:
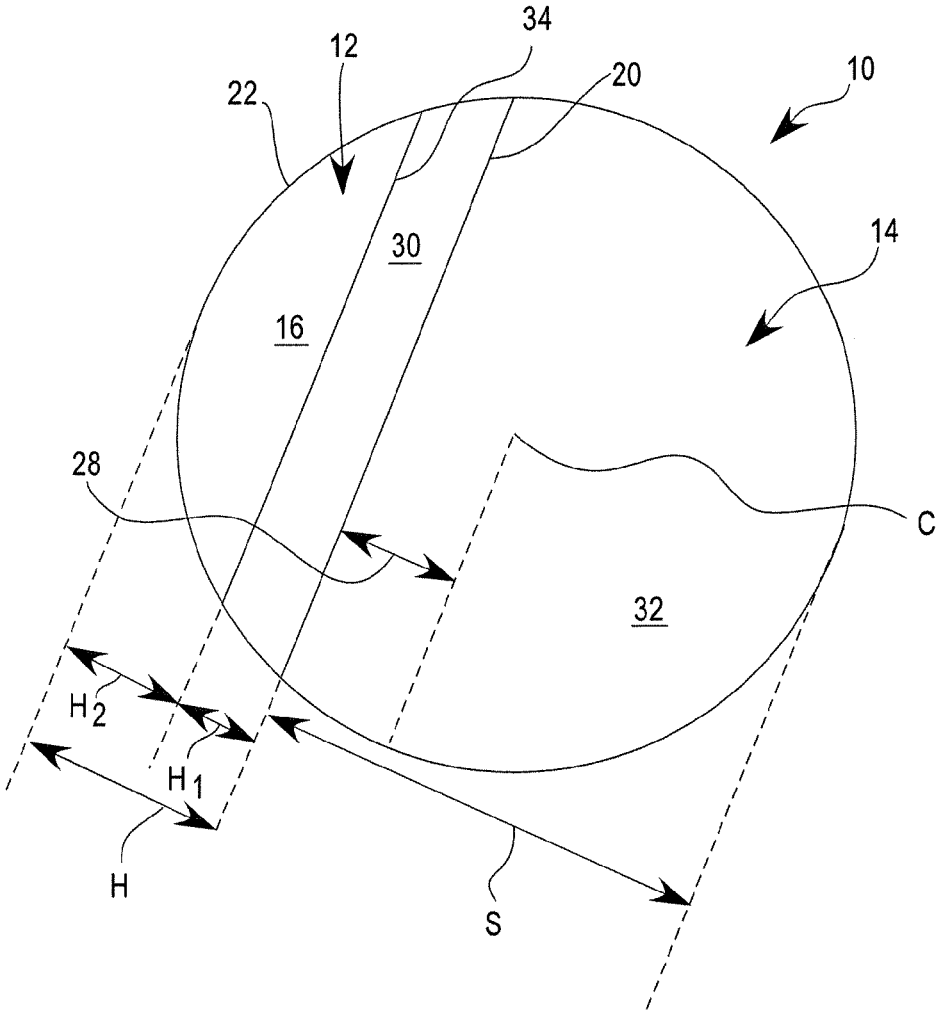
Figure 10:
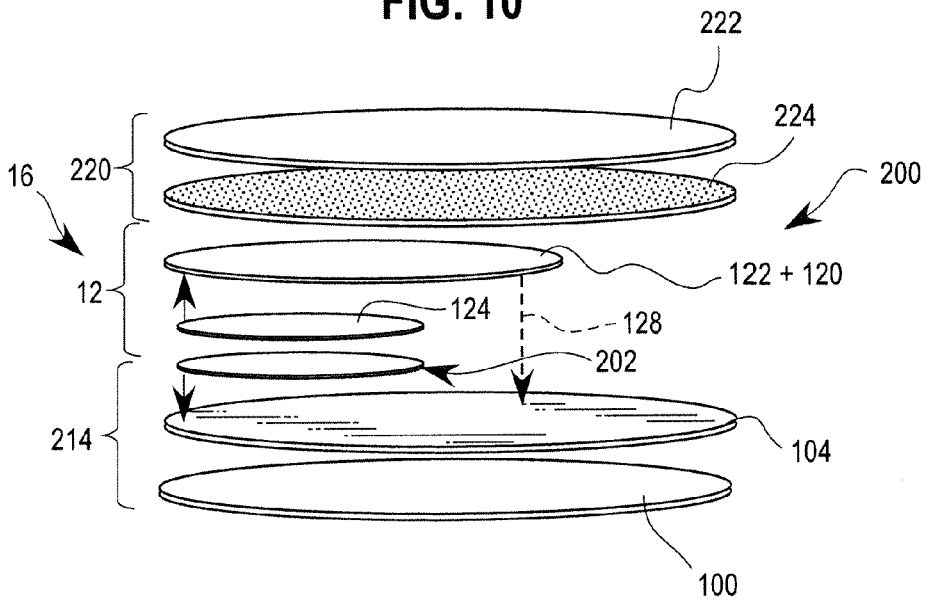
FIG. 10 is a cross-sectional view of another exemplary tabbed sealing member.

FIGS. 8 and 9 schematically show some of the relative features of the seal when viewed from above and the unique characteristics of the circular segment upper laminate 12. As shown in FIG. 10, the total upper laminate segment portion 12 may be defined by an angle $\alpha 1$ between radius lines extending from the center C to the endpoints 24 and 26 of about 125° to about 150°, in other approaches, about 130 to about 140°, and in yet other approaches, about 130 to about 138°. This forms an upper laminate segment portion 12 that covers about 10 to about 40 percent of the upper surface of the seal, in other approaches about 14 to about 35 percent of the seal, in yet other approaches, about 20 to about 30 percent of the seal. In this manner, the upper surface of the seals herein are formed from a minor portion of the top layer from the upper laminate portion 12 and by a major portion from the top layer of the lower seal laminate 14.

The tab 16 of the upper laminate circular segment may also define a second circular segment and may be defined by a second angle $\alpha 2$ between radius lines extending outwardly from the center C to endpoints 300 and 302 on opposite sides of a chord defining the pivot line 34 of about 90 to about 120°, in other approaches, about 100 to about 115°, and in yet other approaches, about 105 to about 112°. In this manner, the seals define a tab 16 that wholly defined within a perimeter of the seal in a ratio of tab surface area to the surface area of the bond area 30 of about 1:1 to about 3:1 and in some approaches, about 1:1 to about 2:1. These ratios are achieved even when the upper laminate portion 12 is less than about 50 percent of the seal, in some approaches, less than about 40 percent of the seal, and in yet other approaches, less than about 35 percent of the seal's upper surface area.

Turning to FIG. 9, another schematic of an exemplary sealing member is shown showing various relative relationships between the upper laminate circular segment portion 12 and the upper surface 32 of the lower laminate 14 effective for the sealing member to function as an overlapping tab on several different configurations of lower laminate. In one approach, the upper laminate circular segment 12 has a total height H that is about 15 to about 40 percent (in some approaches, about 20 to about 30 percent) of the total length of the sealing member with the total length of the exposed lower laminate portion 32 being about 60 to about 85 percent (in other approaches, about 70 to about 80 percent) of the total sealing member length. Thus, in some approaches a ratio of the circular segment height to the length of the exposed lower laminate 32 may be about 0.2 to about 0.7.

Turning to FIG. 10, an example of a sealing member 200 including a sub tab layer 202 is shown. In this approach, many of the layers are similar in position and composition to those already discussed above, and these layers will not be discussed further in this alternative approach. In this approach, the sub tab layer 202 is bonded to the lower laminate 214 and, in particular, to the upper surface 32 and in the approach of FIG. 10, the foil layer 104 of the lower laminate 214. The sub tab 202 is not bonded to the tab 16 or the upper laminate 212. While the sub tab layer 202 is shown bonded to a particular lower laminate, the structure of the lower laminate is not particular limited and can be any single or multi-layer film structure.

The sub tab 202 may be a paper layer adhered to the lower laminate via a hot melt adhesive or a film layer (polyolefin, polyester, nylon, etc.) heat bonded or adhered to the lower laminate via a thin coating of adhesive. In some approaches, the sub tab 202 may be about 1 to about 5 mils thick and, in other approaches, about 1 to about 2 mils thick. The sub tab layer may be coextensive with the tab stock 124, which may also be a paper layer so that this approach presents a paper to paper interface between the tab 16 of the upper laminate 12 and the lower laminate 214. The sub tab layer 202 provides structural support and aids in minimizing the formation of folds, creases, wrinkles and other deformities when the tab layer is applied to the lower laminate. The sub tab layer 202 may be particularly advantageous in providing structural support for lower laminates that are 3 mils or less as these are the most prone to such structural defects during handling and cap sealing and, in some cases, when combined with a gripping tab.

In FIG. 10, the sealing member 200 may also include optional upper layers 220 above the tabbed seal. In one approach, the upper layers may provide additional structural support and may include a paper or cellulose backing layer 222 and an adhesive layer 224. The paper backing layer 222 may be about 5 to about 10 mils of paper backing. Adhesive layer 224 may be any of the exemplary adhesive layers discussed above. This approach provides a robust tab 16 but still provides easy access to the container contents by, for instance, piercing or punching through the foil layer via the portions of the seal 200 not covered by the upper laminate 12.

Figure 11:
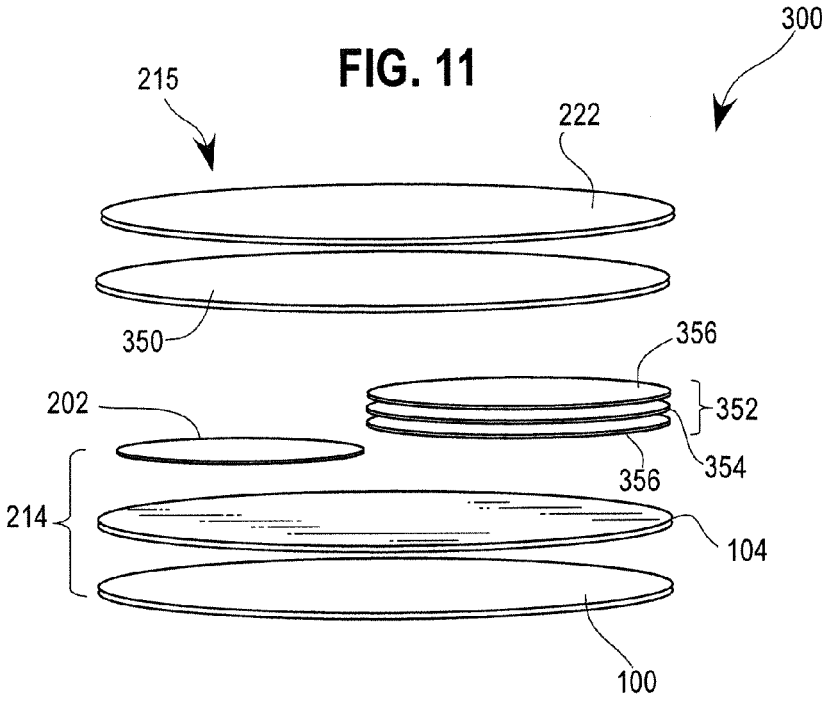
FIG. 11 is a cross-sectional view of another exemplary tabbed sealing member.

FIG. 11 provides yet another example of a sealing member 300 utilizing the sub tab layer 202 combined with a lower laminate 214, which in this approach is similar to that described above with FIG. 10. It will be appreciated, however, that the lower laminate 214 may be any single or multi-layer laminate as needed for a particular application.

In this approach, a tab 215 is formed from a polymer layer 350, which may be a structural polymer layer such as polyester (PET), PEN, nylon, or the like. Above the layer 350 may be an additional support layer, such as backing layer 222 (which may be bonded to layer 350 via adhesive layer 224, which is not shown in FIG. 11). In this approach, the tab is formed via a partial bond or adhesive layer, which does not extend the full length of the seal 300, of a composite adhesive film 352 formed from a polyester layer 354 sandwiched between two outer layers of a heat bondable materials 356 and 358. Composite film layer 352 may be about 2 to about 8 mils thick, and in some approaches, about 3 to about 4 mils thick.

The heat bondable materials 356 and 358 may include any polymer materials that are heat activated to achieve its bonding characteristics. By one approach, the heat-bondable layer may have a density of about 0.9 to about 1.0 g/cc and a peak melting point of about 145° F. to about 155° F. A melt index of the heat bondable material may be about 20 to about 30 g/10 min (ASTM D1238). Suitable examples include ethylene vinyl acetate (EVA), polyolefin, 2-component polyurethane, ethylene acrylic acid copolymers, curable two-part urethane adhesives, epoxy adhesives, ethylene methacrylate copolymers and the like bonding materials.

By another approach, the heat bondable material is EVA with a vinyl acetate content of about 20 to about 28 percent with the remaining monomer being ethylene in order to achieve the bond strengths in order to securely hold the upper laminate to the lower laminate. A vinyl acetate content lower than 20 percent is insufficient to form the robust structures described herein. By one approach, layer 352 may include upper and lower layer 356 and 358 about 0.5 to about 1.5 mil of EVA and, in other approaches, about 0.5 to about 1.0 mils of EVA; however, the thickness can vary as needed for a particular application to achieve the desired bonds and internal strength.

Sealing member 300 may also include the sub tab layer 202 discussed above to provide structural support to the layers above and below the tab. The sub tab layer 202, in this approach, may have similar characteristics as the sub tab layer discussed above. The layer 202 is bonded to the upper surface of the lower laminate and not bonded to the layer(s) 350 forming the tab 215.

In alternative approaches, the sub tab layer 202 may, instead of being coextensive with the primary tab 16 or any tab stock 124 thereof, may extend laterally beyond the boundaries of the tab 16 or tab stock 124. In some approaches, the sub tab layer could be coextensive with the upper laminate or extend over half of the sealing member. In this approach, the sub tab layer could help improve adhesion of the upper laminate to the lower laminate. For instance, if a foam layer is used for the sub tab 202, then the sub tab could extend beyond the tab and tab stock further towards the center of the seal C to engage the bonding area 128, for example, to improve the bond therewith. In this approach, a strong bond would be needed between the extended sub tab layer 202 and the upper surface of the lower laminate (such as the foil layer.)

In another approach, if the sub tab layer 202 was a paper or other absorbent material, then temporarily bonding-type materials or adhesives could be applied to the upper surface of the sub tab to temporarily bond the upper surface of the sub tab to the tab 16 or the tab stock 124 in the upper laminate. In this manner, the temporary bond between the sub tab layer 202 and layers above it in the upper laminate would temporarily bond and/or hold the tab to the lower laminate in order to secure the upper tab substrate for maintaining concentric and/or lateral stability of the entire liner layers, including the tab interface to the lower layer, prior to heat activation and during normal handling and cap assembly.

By one approach, the temporary bond between the sub tab and upper laminate tab or tab stock could be by a wax layer, such as the previously described waxes. In this manner, upon heating to secure the sealing member to the container rim, the heat generated would melt the wax, which would release the tab or tab stock from the sub tab layer and free the tab for normal use. The wax could then be absorbed into the paper or other absorbent material of the sub tab layer similar to how wax is melted and absorbed by a liner in the two-piece assembly constructions described above. The wax could be applied or coated to the top surface of the sub tab layer prior to construction of the sealing member or applied in-line to this component during seal assembly. Alternatively, the temporary bond between the sub tab layer and the upper layers above it could employ alternative release mechanisms, such as dissimilar polymers (such as for example, different polymers on the sub tab and adjacent layers), slip additive loadings to the sub tab or other adjacent layers, cold seal release technology that may provide a temporary bond but would be easily peelable for a consumer to pivot the tab upwardly. In addition, the sub tab layer may further be formed of synthetic short non-woven fibers that are intertwined to form an absorbent sheet, similar to that described in U.S. Pat. No. 7,850,033, which is incorporated herein by reference in its entirety. When forming a temporary bond with the sub tab layer 202, and in some approaches due to the location in the laminate structure, any wax that may be used to form the temporary bond may be a wax with a higher melt point than the waxes discussed above with the two-piece seal and liner constructions. This higher melt point wax can be used in this location without impeding any functionality of the seal and release of the sub tab layer from the other layers during heat sealing. This is because the sub tab layer is positioned closer to the induction heating layer in some approaches.

In summary, the disclosure herein provide for, among other features, a tabbed sealing member for sealing to a rim of a container where the tabbed sealing member includes an overlapping upper laminate that may include a lower seal portion having a top surface with a total surface area and including a heat sealable layer configured for heat sealing to a container rim, an upper laminate at least partially bonded to the top surface of the lower seal portion to form a gripping tab defined wholly within a perimeter of the lower seal portion; and the upper laminate having a top surface with a surface area less than the total surface area of the lower seal portion top surface and forming a circular segment defined by an edge forming a chord extending across the lower seal portion and spaced from a center of the tabbed sealing member. The sealing member further includes a sub tab layer coextensive with the gripping tab. The sub tab layer is bonded to the top surface of the lower seal portion and not bonded to the gripping tab. The sub tab layer may be paper, polymers, polyester, and the like materials. In some approaches, a full backing layer is adhered to both the top surface of the upper laminate and the top surface of the lower seal portion. In some approaches, the backing layer is paper about 5 to about 10 mils thick.

In optional approaches, the tabbed sealing member may also include wherein an upper laminate with a heat activated bonding layer forming the at least partial bond to the top surface of the lower seal portion or a tab stock bonded to the heat activated bonding layer but not bonded to the top surface of the lower seal portion to form the gripping tab. In other approaches, an upper surface of the tabbed sealing member may be partially defined by a minor portion of the top surface of the upper laminate and a major portion of the top surface of the lower seal portion. The upper surface of the tabbed sealing member may also be temporarily bonded to a liner with portions of the liner are temporarily bonded to the top surface of the upper laminate and other portions of the liner are temporarily bonded to the top surface of the lower seal portion.

In some approaches, the lower seal portion may have a thickness and composition configured to be pierced through portions of the tabbed sealing member not covered by the upper laminate.

In some approaches, the circular segment forming the upper laminate may be defined by a sweep angle of the formula 2 arccos (H1/radius). In some approaches, this angle may be about 125 to about 150°. In other approaches, the tab of the upper laminate is a circular segment being less than a semicircle and defined by a second sweep angle of the formula 2 arccos (H2/radium). In some approaches, this angle may be about 90 to about 120°.

The circular segment of the upper laminate, in some forms, may cover about 10 to about 40 percent of the upper surface of the tabbed sealing member with the remainder of the upper surface being the top surface of the lower seal portion.

The lower seal portion, in some alternative approaches, may include a variety of different materials and layers. For instance, the lower seal portion may include a metal foil, and the top surface of the lower seal portion may be the metal foil. The lower seal portion may also include a foamed polymer, or the top surface of the lower seal portion may be a polymer film selected from polyolefin materials and polyester materials.

In other approaches, a tabbed sealing member for sealing to a rim of a container is described that includes a lower seal portion having a top surface with a total surface area and including a heat sealable layer configured for heat sealing to a container rim. The seal further includes an upper laminate at least partially bonded to the top surface of the lower seal portion to form a gripping tab defined wholly within a perimeter of the lower seal portion. The partial bond is formed by a composite layer of a polyester sandwiched between heat bondable materials on opposite sides of the polyester. The seal also includes a sub tab layer coextensive with the gripping tab. The sub tab layer is bonded to the top surface of the lower seal portion, but not bonded to the gripping tab. In some alternative approaches, the tabbed sealing the upper laminate includes a layer of polyester and a paper backing layer.

It will be understood that various changes in the details, materials, and arrangements of the process, liner, seal, and combinations thereof, which have been herein described and illustrated in order to explain the nature of the products and methods may be made by those skilled in the art within the principle and scope of the embodied product as expressed in the appended claims. For example, the seals may include other layers within the laminate and between the various layers shown and described as needed for a particular application. Adhesive layers not shown in the Figures may also be used, if needed, to secure various layers together. Unless otherwise stated herein, all parts and percentages are by weight.

What is claimed is:

1. A tabbed sealing member for sealing to a rim of a container, the tabbed sealing member comprising:

a lower seal portion having a top surface with a total surface area and including a heat sealable layer configured for heat sealing to a container rim;

an upper laminate at least partially bonded to the top surface of the lower seal portion to form a gripping tab defined wholly within a perimeter of the lower seal portion;

the upper laminate having a top surface with a surface area less than the total surface area of the lower seal portion defining a circular segment with an edge forming a chord extending across the lower seal portion; and a sub tab layer coextensive with the gripping tab, the sub tab layer bonded to the top surface of the lower seal portion and not bonded to the gripping tab.

2. The tabbed sealing member of claim 1, wherein the upper laminate includes a heat activated bonding layer forming the at least partial bond to the top surface of the lower seal portion.

3. The tabbed sealing member of claim 2, wherein the upper laminate includes a tab stock bonded to the heat activated bonding layer but not bonded to the top surface of the lower seal portion.

4. The tabbed sealing member of claim 1, wherein the lower seal portion has a thickness and composition configured to be pierced through portions of the tabbed sealing member not covered by the upper laminate.

5. The tabbed sealing member of claim 1, wherein the circular segment of the upper laminate covers about 10 to about 40 percent of an upper surface of the tabbed sealing member with the remainder of the upper surface being the top surface of the lower seal portion.

6. The tabbed sealing member of claim 1, wherein the lower seal portion includes a metal foil.

7. The tabbed sealing member of claim 6, wherein the top surface of the lower seal portion is the metal foil.

8. The tabbed sealing member of claim 6, wherein the lower seal portion includes a foamed polymer.

9. The tabbed sealing member of claim 6, wherein the top surface of the lower seal portion is a polymer film selected from polyolefin materials and polyester materials.

10. The tabbed sealing member of claim 1, wherein the sub tab layer is selected from paper, polymer materials, and combinations thereof.

11. The tabbed sealing member of claim 1, wherein a backing layer is adhered to both the top surface of the upper laminate and the top surface of the lower seal portion.

12. The tabbed sealing member of claim 11, wherein the backing layer is a paper layer about 5 to about 10 mils thick.

13. The tabbed sealing member of claim 1, wherein the upper laminate is at least partially bonded to the top surface of the lower seal portion adjacent the edge forming the chord extending across the lower seal portion and not bonded adjacent at least a portion of a circular edge of the upper laminate to form the gripping tab.

14. The tabbed sealing member of claim 1, wherein the upper laminate includes a pivot line positioned between the edge forming the chord extending across the lower seal portion and at least a portion of a circular edge of the upper laminate.

15. A concentrically stable tabbed sealing member for sealing to a rim surrounding a container opening, the sealing member formed of a multi-layer laminate comprising:

a lower laminate portion including a heat seal layer for bonding to the container rim, a metal foil layer above the heat seal layer for heating the heat seal layer, a polymer foam layer above the metal foil layer, and at least one non-foam polymer film support layer above the polymer foam layer;

an upper laminate portion partially bonded to the lower laminate portion and including a free portion not bonded to the at least one non-foam polymer film support layer and forming a gripping tab defined wholly within a perimeter of the sealing member, the gripping tab for removing the sealing member from a container opening; and the at least one non-foam polymer film support layer coextensive with at least the gripping tab at a periphery thereof to provide structural support and stabilize the lower laminate portion below the gripping tab of the sealing member.

16. The sealing member of claim 15, further comprising a tab stock polymer layer extending partway across the concentrically stable tabbed sealing member, the tab stock polymer layer bonded one of the layers in the upper laminate portion and not bonded to the lower laminate portion.

17. The sealing member of claim 16, wherein the at least one non-foam polymer film support layer is bonded to the polymer foam layer and not bonded to the tab stock polymer layer.

18. The sealing member of claim 15, wherein the at least one non-foam polymer film support layer is bonded to the polymer foam layer and not bonded to the free portion forming the gripping tab.

19. The sealing member of claim 15, wherein the at least one non-foam polymer film support layer is at least one non-foam polyolefin film layer.

20. The sealing member of claim 15, wherein the at least one non-foam polymer film support layer is about 1 to about 5 mils thick.

21. The sealing member of claim 15, wherein the polymer foam layer has an internal rupture strength of about 2,000 to about 3,500 grams per inch.

22. The sealing member of claim 15, wherein the polymer foam layer has a density of about 0.4 to about 0.6 grams per cubic centimeter.

23. The sealing member of claim 15, wherein the upper laminate portion includes a heat activated bonding layer forming the at least partial bond to the lower laminate portion.

24. The sealing member of claim 23, wherein the heat activated bonding layer is selected from the group consisting of ethylene vinyl acetate, polyolefin, two-component polyurethane, ethylene acrylic acid copolymers, curable two-part urethane adhesives, epoxy adhesives, ethylene methacrylate copolymers, and combinations thereof.

25. The sealing member of claim 15, wherein the at least one non-foam polymer film support layer includes one of an amorphous polymer layer, a crystallized polymer layer, and co-extruded combinations thereof.

26. The sealing member of claim 25, wherein the at least one non-foam polymer film support layer is a co-extruded polymer having an amorphous layer forming a bond with the upper laminate and a crystallized layer forming a bond to the polymer foam layer.

27. The sealing member of claim 26, wherein the crystallized layer is thicker than the amorphous layer.

* * * * *